US005660062A

United States Patent [19]

Diestel et al.

[11] Patent Number: 5,660,062

[45] Date of Patent: Aug. 26, 1997

[54] PROCESS AND INSTALLATION FOR PRODUCING TEXTILE NET-LIKE FABRICS

[75] Inventors: Olaf Diestel; Gerd Franzke; Peter Offermann; Wolfram Schinkoreit, all of Dresden, Germany

[73] Assignee: Textilma AG, Hergiswil, Switzerland

[21] Appl. No.: 491,918

[22] PCT Filed: Dec. 30, 1993

[86] PCT No.: PCT/EP93/03717

§ 371 Date: Sep. 5, 1995

§ 102(e) Date: Sep. 5, 1995

[87] PCT Pub. No.: WO94/17230

PCT Pub. Date: Aug. 4, 1994

[30] Foreign Application Priority Data

Jan. 19, 1993 [DE] Germany ..... 43 01.232.9

[51] Int. Cl.[6] ..... D04B 21/10; D04B 21/14; D04B 23/10; D04B 35/00

[52] U.S. Cl. ..... 66/85 R; 66/214

[58] Field of Search ..... 66/85 R, 85 A, 66/203, 204, 214

[56] References Cited

U.S. PATENT DOCUMENTS

| | | | |
|---|---|---|---|
| 3,013,419 | 12/1961 | MacCaffray, Jr. | 66/85 R |
| 3,140,592 | 7/1964 | Clark | 66/85 R X |
| 3,428,007 | 2/1969 | Wignall et al. | 66/85 R X |
| 4,417,456 | 11/1983 | Bergmann et al. | 66/214 |
| 4,433,493 | 2/1984 | Poisson . | |

FOREIGN PATENT DOCUMENTS

| | | | |
|---|---|---|---|
| 0276890 | 8/1988 | European Pat. Off. . | |
| 1152130 | 2/1958 | France | 66/85 |
| 66995 | 11/1891 | Germany . | |
| 122402 | 5/1899 | Germany . | |
| 437459 | 3/1924 | Germany | 66/85 |
| 612547 | 4/1935 | Germany . | |
| 1236119 | 12/1959 | Germany . | |
| 2722094 | 12/1977 | Germany . | |
| 2706930 | 8/1978 | Germany . | |
| 3823475 | 1/1989 | Germany . | |
| 269298 | 6/1989 | Germany . | |
| 4140826 | 6/1993 | Germany . | |

OTHER PUBLICATIONS

Hans Lehner, Looking at the Position for Warp Knitting in Relation to the Technical Textiles Market, pp. 38 and 39.

*Primary Examiner*—John J. Calvert
*Attorney, Agent, or Firm*—Friedrich Kueffner

[57] ABSTRACT

The invention is directed to a process and a device for the production of textile net-like fabrics by various bonding processes, e.g., the warp knitting process or stitch bonding process. Based on the object of the invention—to provide a process and a device for carrying out the process by various bonding processes, e.g., the warp knitting process or stitch bonding process, for producing textile net-like fabrics with large mesh widths, a high variability of structure, and product widths extending beyond the working width—a plurality of adjacent groups of mesh side threads forming the mesh sides in the working direction are produced, at least one function thread (4) is joined with at least one group of mesh side threads (1), the function threads are guided out of the group of mesh side threads transversely to the working direction to form the other mesh side lying transversely to the working direction, at least one function thread (4) is formed in a loop in order to form function thread reserves, and the function thread is joined with at least one group of mesh side threads (1).

6 Claims, 8 Drawing Sheets

PROCESS AND INSTALLATION FOR PRODUCING TEXTILE NET-LIKE FABRICS

The invention is directed to a process and a device for the production of textile net-like fabrics by various bonding processes, e.g., the warp knitting process or stitch bonding process.

In the textile industry, nets are commonly manufactured with known net-tying machines or net-knotting machines by means of knotting hooks or with known warp knitting machines or stitch bonding machines by means of latch needles or slide needles. In so doing, it is disadvantageous that the product width is determined by the working width and by the mesh structure and that the variability of structure is sharply restricted by the processes or can only be realized at a high cost as is the case in warp-knitted net with a varied net mesh size in the edge region requiring the use of a plurality of guide bars and varied lapping or threading (JP 51-57041). The usability of the products is limited due to the bunching of yarns in the knot region and because of the resulting sensitivity to abrasion and their limited variability with respect to structure.

A modified warp knitting machine is known (DE 2706930) for working plastic yarns with parallel weft insertion in which the yarns are bonded by means of fusing swords. The product width which can be produced in this way only corresponds to the working width of the machine. The net mesh geometry is determined by the fixed working width and the arrangement of the bonding elements, i.e., the fusing swords. Further, only thermoplastic materials can be processed by the selected bonding method so that the range of possible applications of the product is limited.

Stitch bonding machines on which square-mesh nets can be manufactured are also known (DD 269298). For this purpose, parallel weft yarns are entered transversely to the working direction and are passed through in the work location at determined intervals transversely to the working direction by working members forming wale portions and are tied on or tied in by means of stitching yarns looping around the warp yarns.

It is disadvantageous that only square-mesh nets with continuous weft yarns and warp yarns can be realized and that the size of the mesh apertures which is determined by the distance between the inserted weft yarns and the relative distance between the working members forming the wales can only be changed to a limited extent and in an uneconomical manner. Further, the maximum product width is equal to the working width and the products have low strength due to the fact that the weft yarns pattern is also tacked by bearded needles not participating in mesh formation.

The object of the present invention is to provide a process and a device for carrying out the process by various bonding processes, e.g., the warp knitting process or stitch bonding process, for producing textile net-like fabrics with large mesh widths, a high variability of structure, and product widths extending beyond the working width.

This object is met, according to the invention, by the characterizing part of the patent claims. Advantageous constructions, are disclosed in the dependent claims.

The solution according to the invention is explained more fully in the following with reference to an embodiment example.

FIGS. 11*a–f* show product structures.

Figure 1:
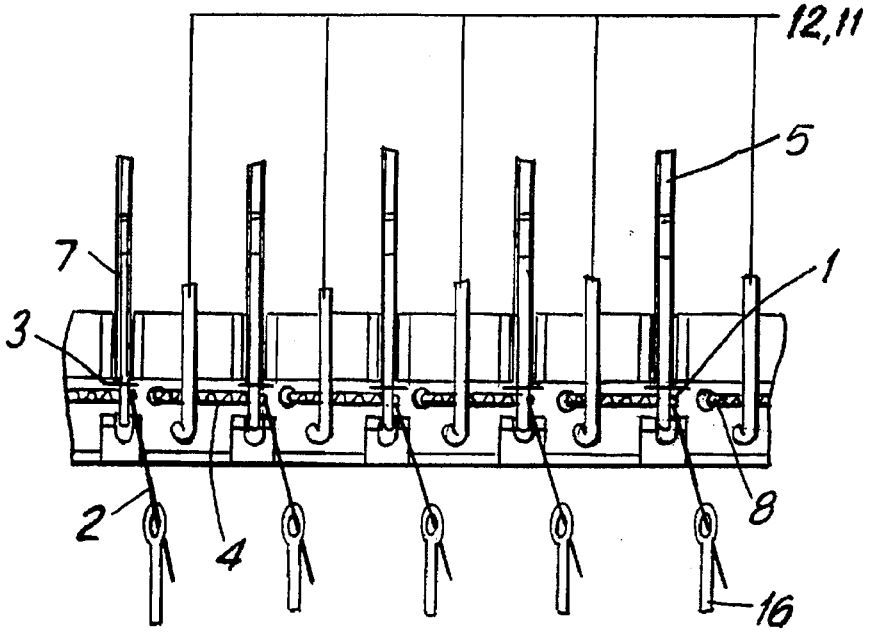
FIG. 1 shows a schematic view of the following process steps: production of groups of mesh side yarns, joining of a function yarn with a group of mesh side yarns, and guiding out of the function thread.
Figure 2:
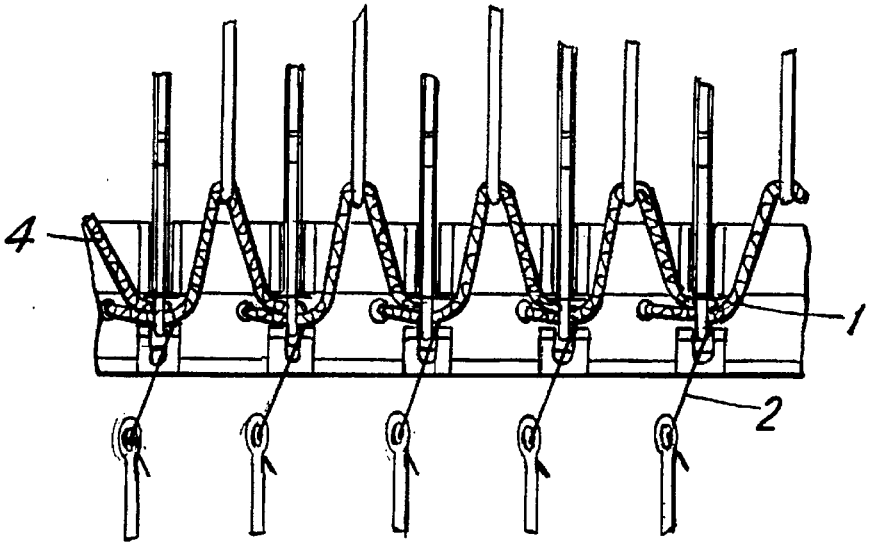
FIG. 2 shows a schematic view of the following process steps: formation of a function yarn reserve and joining with a group of mesh side yarns.
Figure 3:
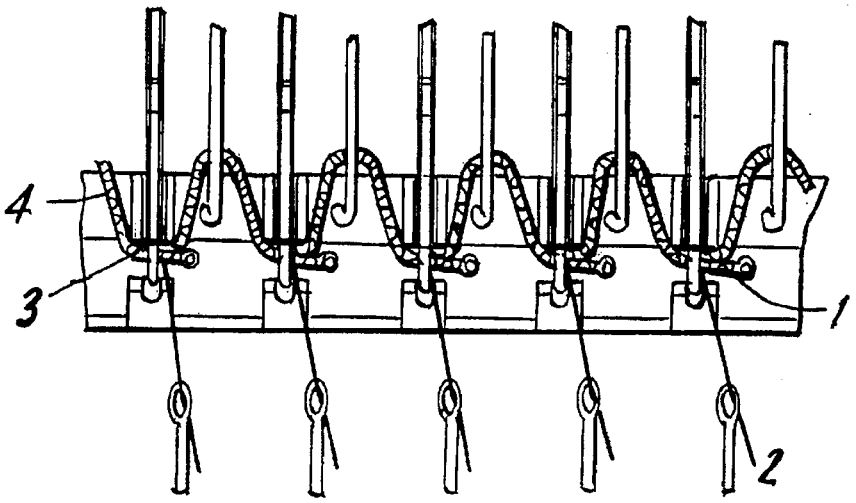
FIG. 3 shows a schematic view of the process step for achieving the initial position.

The process steps according to the invention are shown schematically in FIGS. 1 to 3 with reference to a stitch bonding work location. The groups of mesh side yarns 1 comprising a sewing yarns or stitching yarns 2, a stationary weft yarns 3, and function yarns 4 are fed to the stitch bonding work location in a known manner. In so doing, a stable mesh side comprising a wale is formed in the working direction by means of a pillar stitch formation of the stitching yarns 2. In the process of forming the mesh, the strip-shaped stationary weft yarns 3 and the function yarns 4 are passed through and the function yarn is joined with the group of mesh side yarns 1. This formation of the mesh sides in the working direction can be varied in a known manner by omitting the stationary weft yarns 3, by the number of connected wales in the mesh side and, when there is more than one wale in the mesh side, by another bonding of the stitching yarns 2.

FIG. 1 shows the point in time at which the function yarns 4 are guided out of the region of the mesh side, yarn group 1 toward the left during the mesh formation by means of a lateral racking movement or offsetting movement.

As is shown in FIG. 2, the function yarn 4 has been lapped under the adjacent slide needles, the function yarn reserves have been formed by the deflection of the function yarns 4 in the working direction or opposite thereto, and a loop has been formed. The formed function yarn reserves are released and tied on or tied in at the same time so as to be secured in the adjacent group of mesh side yarn 1. By function yarn reserve is meant a loop-shaped yarn reserve which is formed in the system of function yarns during the formation of a textile net in the process of mesh formation and which can be canceled when the textile product is transferred from its production position to the use position (spreading).

FIG. 3 shows the movement into the initial position. The function yarns 4 are guided out of the group of mesh side yarns 1 at an appropriate time depending on the mesh geometry and a new function yarn reserve is formed.

In the process according to the invention, the function yarn can be tied on or tied in at one of the adjacent groups of mesh side yarns or in the same group of mesh side yarns. In so doing, none of the function yarns reserves and/or the same function yarns reserves and/or different function yarn reserves can be formed from the function yarns transversely and in the working direction. The function threads provided with function yarn reserves can be introduced in the working direction at right angles to the working direction, that is, tied in within the same working cycle, or diagonally to the working direction, that is, tied in within the next working cycle.

Figure 4:
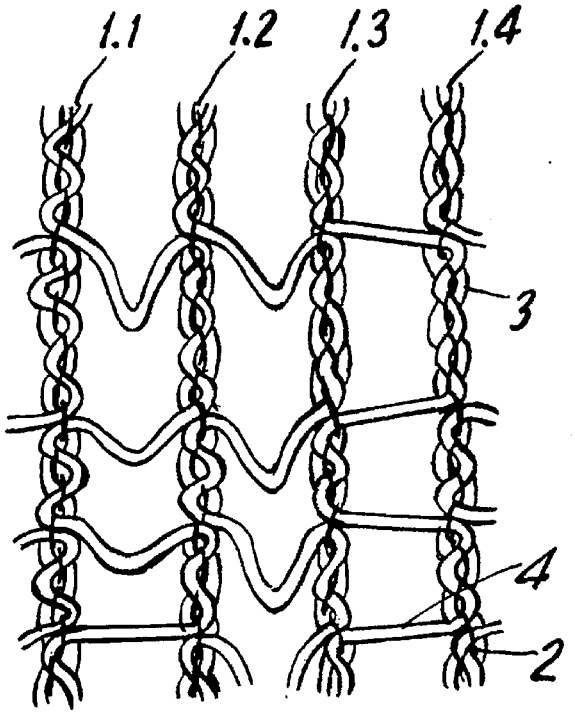
FIG. 4 shows a stitch-bonded net-like textile fabric in the production position.
Figure 5:
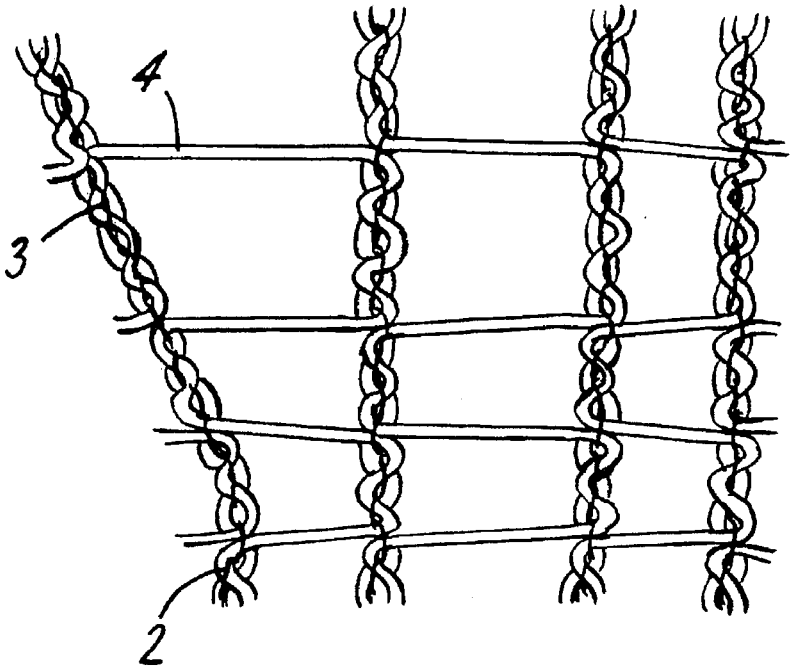
FIG. 5 shows a stitch-bonded net-like textile fabric in the use position.

The product, according to the invention, which is produced according to the stitch bonding process is shown in the production position in FIG. 4 and in the use position in FIG. 5.

As will be seen from FIG. 4, stationary weft yarns 3, stitching yarns 2 and function yarns 4 form the groups of mesh side yarns and accordingly form the mesh sides of the net in the working direction in the manner described above. The function yarns which are tied on or tied in alternately into two adjacent groups of mesh side yarns form the function yarn reserves. FIG. 5 shows the textile net in the use position. The function yarn reserves are canceled, the function yarns are stretched out and accordingly form mesh sides which preferably lie transversely to the working direction. As will be seen from the drawing, the function yarn 4 is deflected by decreasing amounts, or not at all, in the working direction between the first and second groups of mesh side yarn 1.1; 1.2, i.e., different function yarn reserves are formed; the function yarn 4 is deflected by identical amounts between the second and third groups of mesh side yarns 1.2; 1.3, i.e., identical function yarn reserves are formed; and the function yarn 4 is not deflected between the third and fourth groups of mesh side yarns 1.3; 1.4, i.e., no function yarn reserves are formed. This configuration results in a product as shown in FIG. 5 in the use position.

Figure 6:
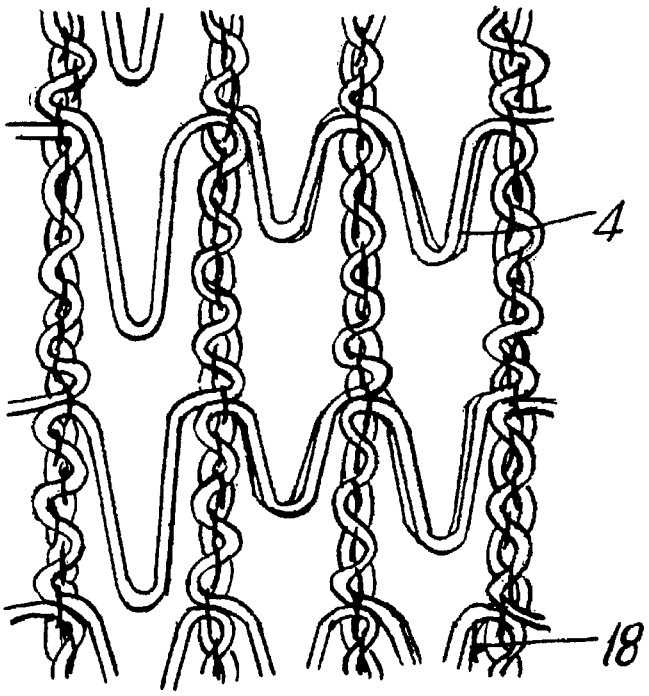
FIG. 6 shows a warp-knitted net-like textile fabric in the production position.
Figure 7:
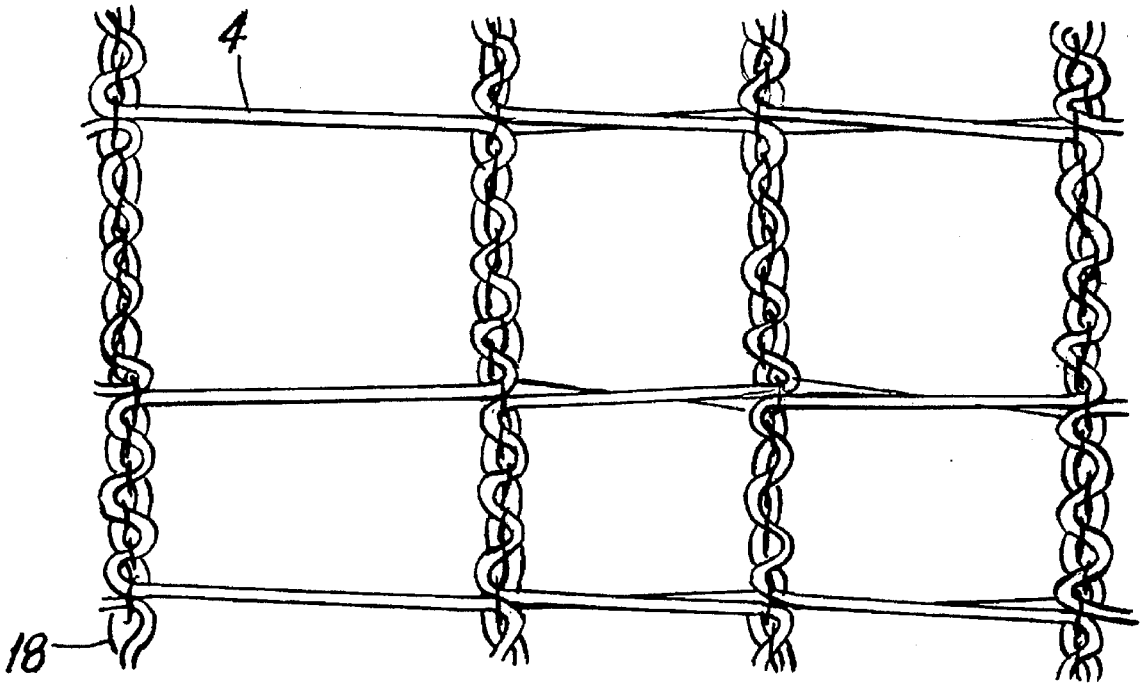
FIG. 7 shows a warp-knitted net-like fabric in the use position.

If the product were produced by warp knitting, this would result in the product structure shown in FIGS. 6 and 7 in the production position and use position. The groups of mesh side yarns are formed of a warp yarn 18 and two function yarns 4 which are lapped or laid in opposite directions. The groups of mesh side yarns form the mesh sides of the net in the working direction in a known manner. The function yarns in the group of mesh side yarns are tied in or tied on by underlapping in a manner typical of the warp knitting process.

Tying on or tying in and the formation of the group of mesh side yarns from at least one warp yarn and at least one function yarn or from at least one warp yarn, at least one stationary weft yarn and at least one function yarn can also be carried out according to the known crochet galloon process. The function yarn can be tied on or tied in at the group of mesh side yarns by tacking the function yarn during the formation of the mesh and tying it in as a partial filling or loop. It is also possible to tie on or tie in by means of thermal or chemical setting.

Figure 8:
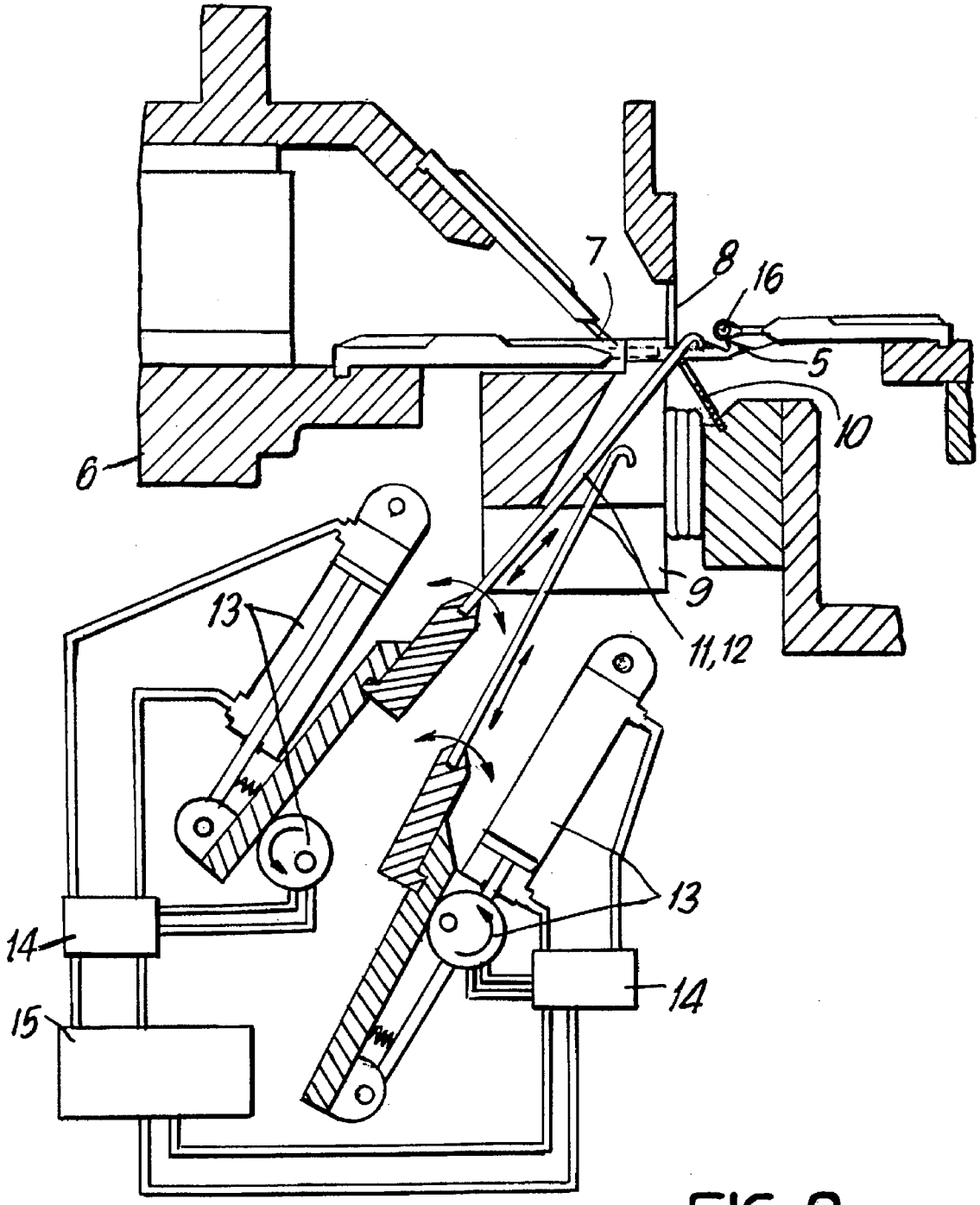
FIG. 8 shows a stitch bonding work location.

FIG. 8 shows a device for carrying out the described process in which the group of mesh side yarns and the function yarn 4 are joined by means of a bonding device constructed as a stitch bonding work location. The stitch bonding work location comprises the following: a plurality of slide needles 5 which are assembled on a needle bar 6 and can be moved jointly, a closing wire 7 being associated with each slide needle 5; one or more yarn guides which are constructed as guide bars and have yarn guide elements which are mostly constructed as eye needles 16; and—with function yarn guides 8 constructed as guide tubes arranged over the slide needles 5 as in the construction shown in the drawing—a plurality of knock-over elements 9 arranged in each instance between the slide needles 5; and a back-stop rail 10. According to the invention, a system 11 forming a function yarn reserve which acts on at least one function yarn 4 at least between two slide needles 5 adjoining one another transversely with respect to the working direction is arranged in the stitch bonding work location. In the construction shown in the drawing, this system 11 is formed of a plurality of elements for forming a function yarn reserve, which elements are constructed as spring bearded needles or hooked needles 12 and are fastened in a stationary manner in a row on two bars which extend transversely to the working direction along the entire working width of the machine, one on top of the other, so as to be movable and also swivelable vertically to their longitudinal axis. In the system 11 for forming a function yarn reserve, a drive 13 constructed as a gear unit is associated with every bar, a variation control 14 is associated with every drive, and a patterning control 15 is associated with the system as a whole.

Figure 9:
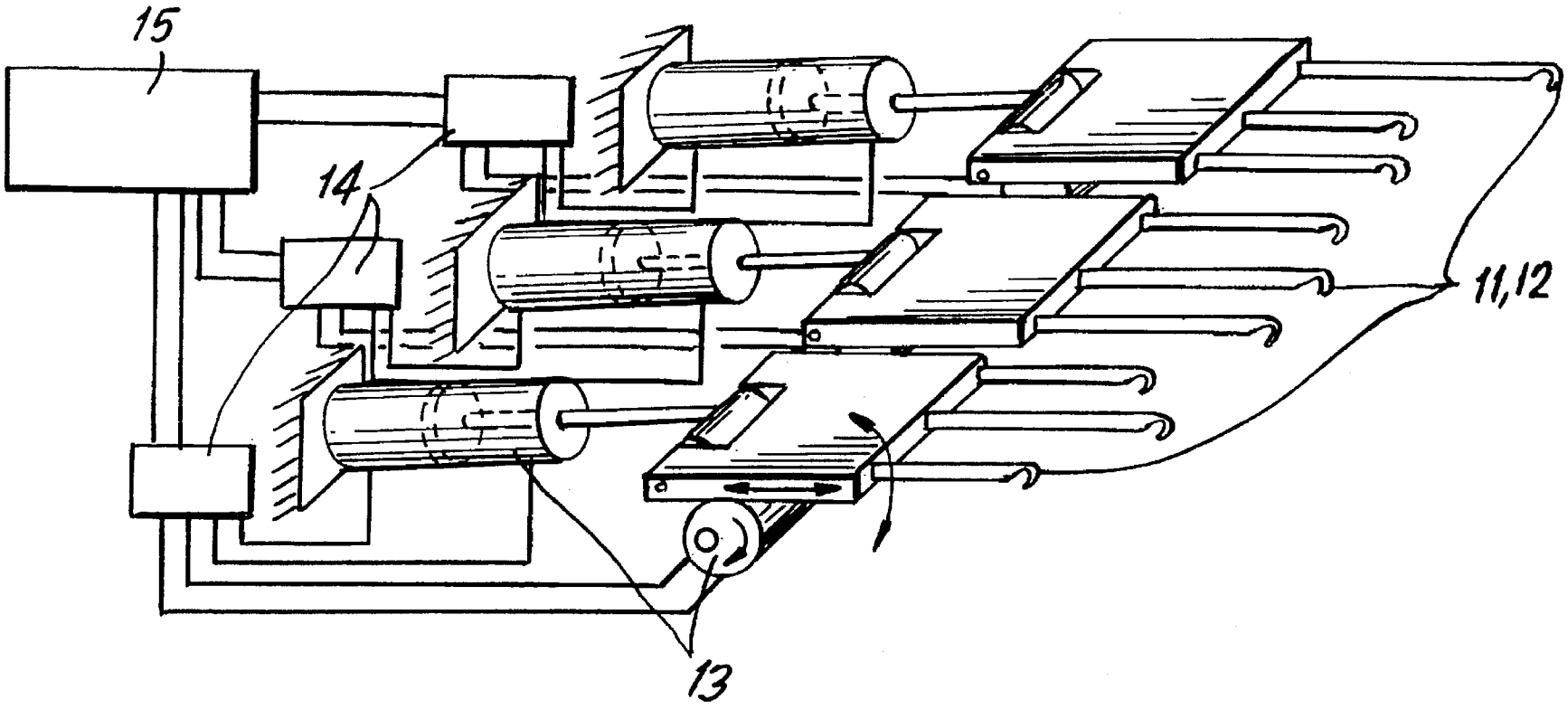
FIG. 9 shows a system for forming a yarn reserve.

FIG. 9 shows another possible embodiment form of a system 11 for forming a function yarn reserve. The elements for forming a function yarn reserve are constructed as hooked needles 12 and are fastened in a row in a stationary manner on a plurality of needle bars 6 which are arranged adjacent to one another in a row transversely to the working direction and are movable and also swivelable vertically to their longitudinal axis. In the system for forming a function yarn reserve, a drive 13 which is constructed as a gear unit and has an associated variation control 14 is associated with every needle bar 6 and a patterning control 15 is associated with the overall system.

Figure 10:
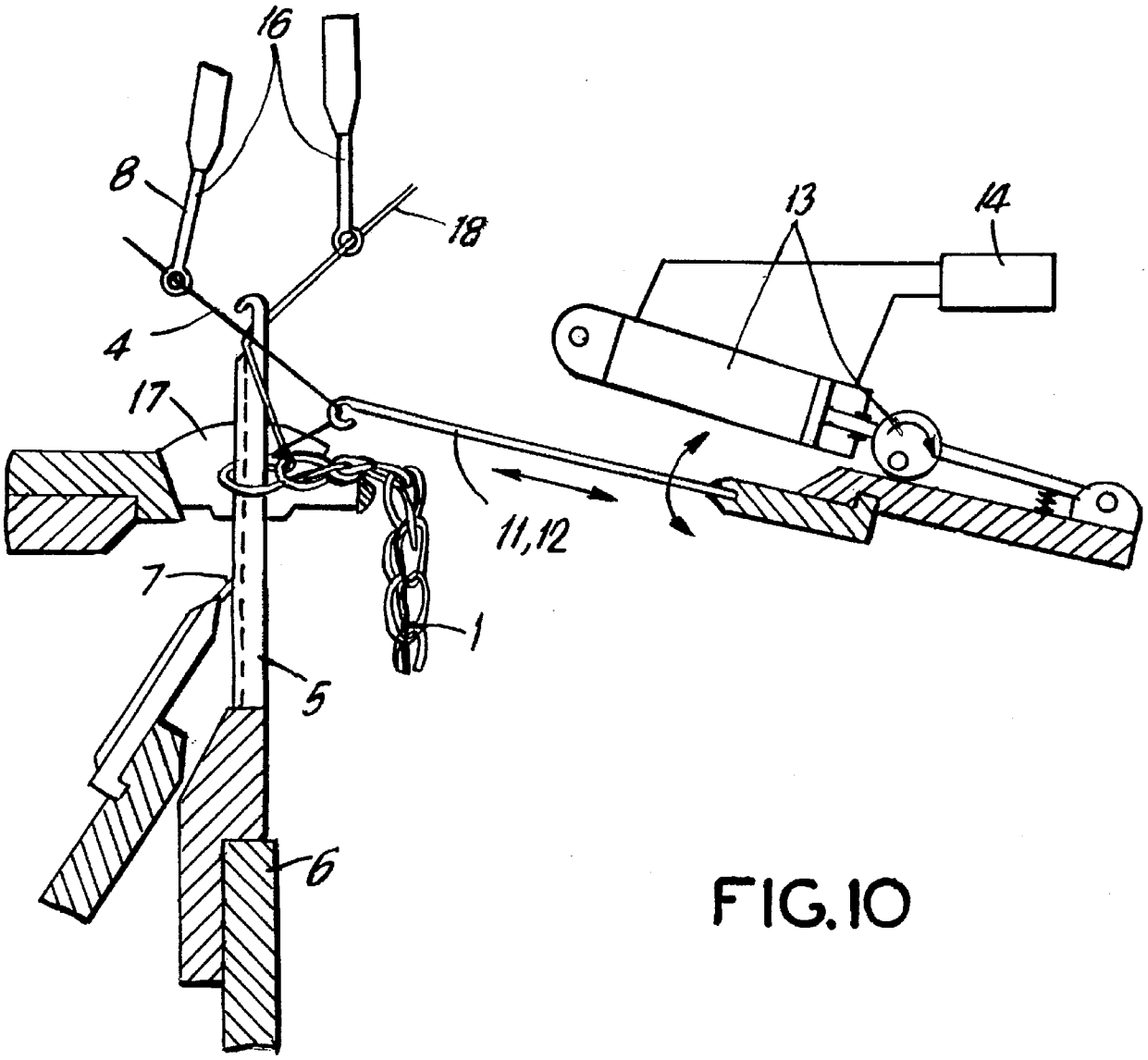
FIG. 10 shows a warp knitting work location.
Figure 11A:
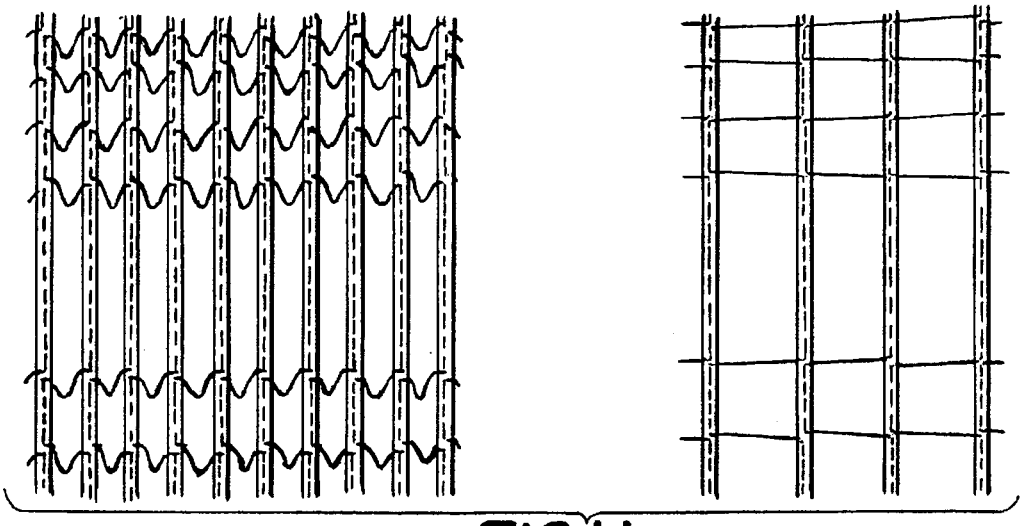
Figure 11B:
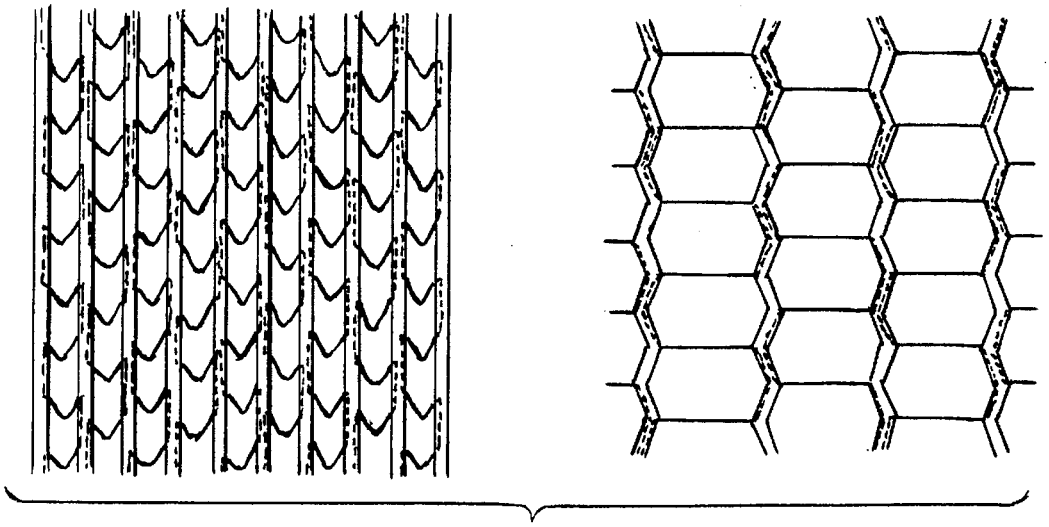
Figure 11C:
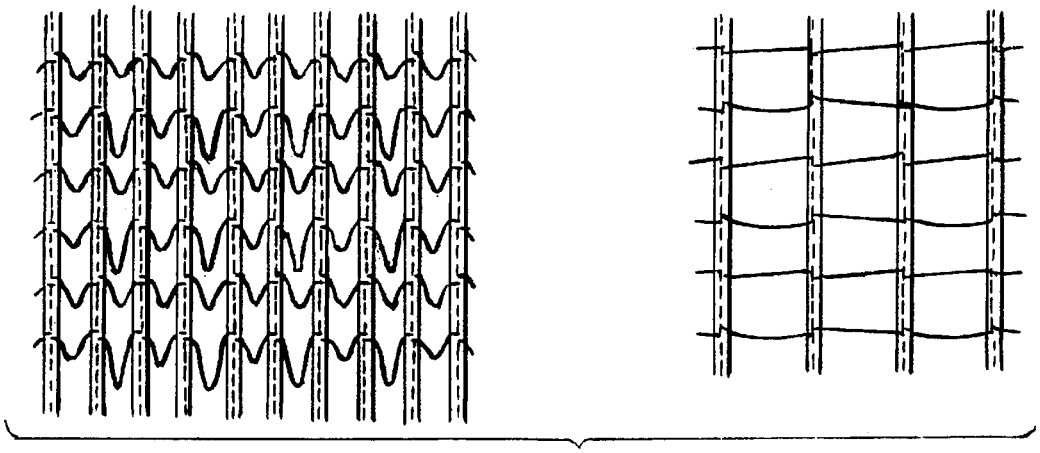
Figure 11D:
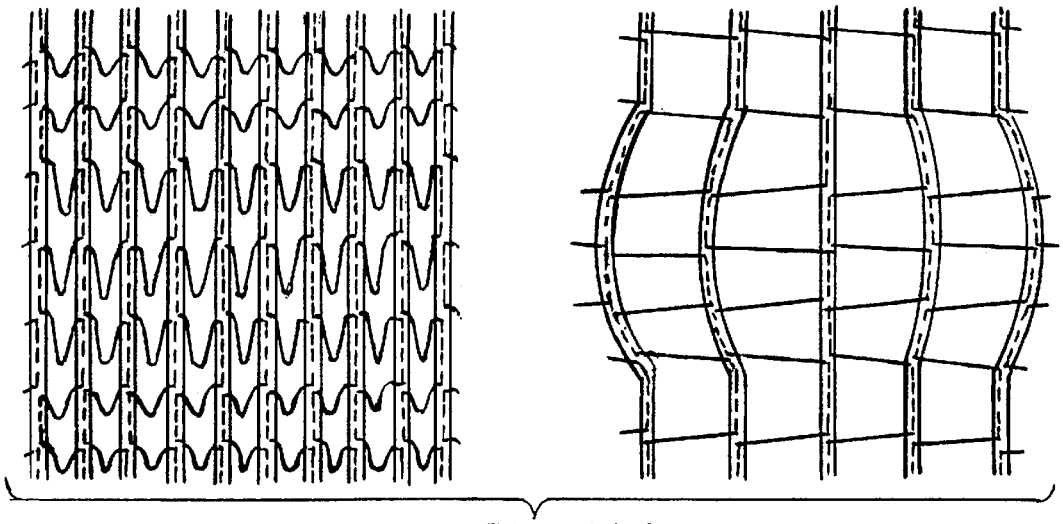
Figure 11E:
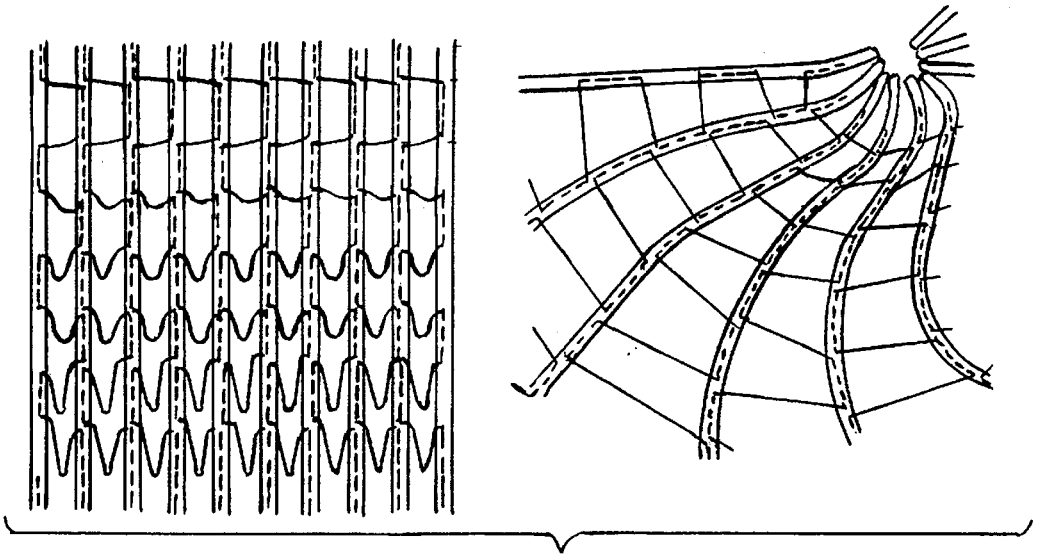
Figure 11F:
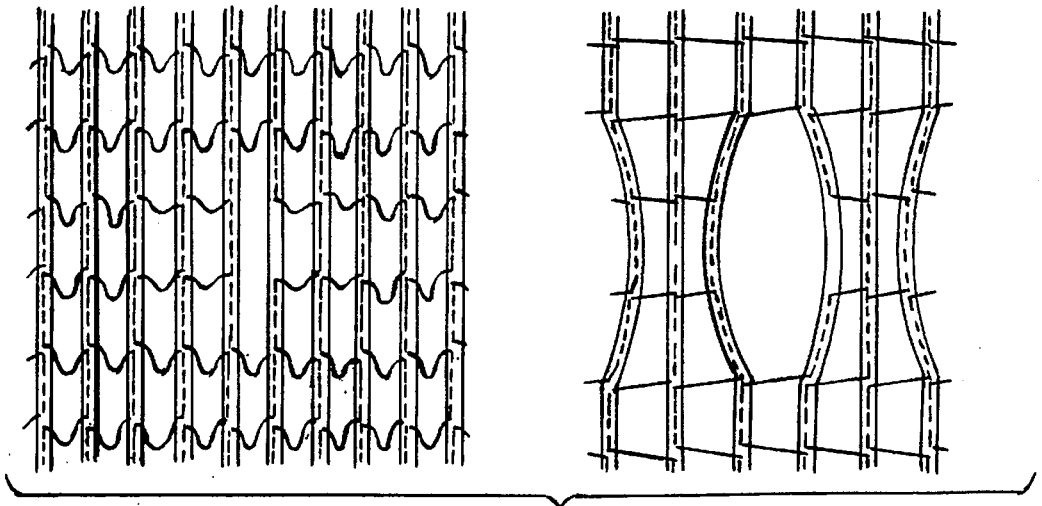

FIG. 10 shows a device for carrying out the described process. The joining of the group of mesh side yarns 1 and the function yarn 4 is carried out by means of a bonding device which is constructed as a warp knitting work location. The warp knitting work location is formed of a plurality of knitting needles—constructed in the present instance as slide needles 5 with closing wire 7—which are combined on a needle bar 6 so as to be movable jointly, one or more yarn guides which are constructed as guide bars and have yarn guide elements which are constructed as eye needles 16 for guiding the warp yarn 18 and function yarn 4, and a plurality of combined hold-down sinkers and knock-over sinkers 17 arranged between the slide needles 5 on a bar. According to the invention, a system 11 for forming a function yarn reserve which acts on at least one function yarn 4 at least between two slide needles 5 adjoining one another transversely to the working direction is arranged in the warp knitting work location. In the construction shown in the drawing, the system 11 is constructed with a plurality of elements for forming a function yarn reserve, these elements being constructed as hooked needles 12 which are fastened in a row in a stationary manner on a bar which is movable and also swivelable vertically relative to its longitudinal axis. A drive 13 with an adjustable lift is associated with the system 11 for forming a function yarn reserve and a variation control 14 is associated with this drive 13.

Other combinations of arrangement of the knitting needles or slide needles 5 with systems 11 for forming a function yarn reserve are also possible. Displacing elements such as sinkers, latch needles or slide needles, grippers, etc. can also be used as systems for forming a function yarn reserve, these elements being rigid or movable jointly and/or by groups and/or individually.

The operation of the devices according to the invention is described in the following. The operation of the embodiment form of a system 11 for forming a function yarn reserve shown in FIGS. 8 and 9 is shown schematically in FIGS. 1 to 3. The groups of mesh side threads 1 formed of stitching yarns 2, stationary weft yarns 3, and function yarns 4 are fed to a stitch bonding work location in a known manner. In so doing, a stable mesh side comprising a wale is formed in the working direction by means of a pillar stitch formation of the stitching yarns 2. In the process of forming the mesh, the strip-shaped stationary weft yarns 3 and the function yarns 4 can be passed through by the slide needles 5. FIG. 1 shows the time at which the function yarns 4 are guided out of the region of the group of mesh side yarns 1 toward the left during the mesh formation by means of a lateral offsetting movement of the function yarn guides 8. The elements for forming a function yarn reserve which are constructed as hooked needles 12 which open downward grasp the function yarns 4 in that they are moved in the direction of the eye needles 16 and their hooked ends are folded down at the same time by a swiveling movement of the entire bar. The formation of the function yarn reserves must be concluded when the function yarn 4 has been lapped under the slide needles 5 or when the function yarn has been tacked by the slide needle. In FIG. 2, the underlapping of the slide needles 5 and the formation of the function yarn reserves are concluded by the return movement of the hooked needles 12. The function yarn reserves are released by an upward swiveling movement of the bar and are tied on or tied in at the same time by the slide needles 5 so that they are secured in the adjacent group of mesh side yarns 1.FIG. 3 shows the movement of the system 11 for forming a function thread reserve in the direction of the slide needle tips into the initial position. Depending on the net mesh geometry, the function yarns 4 are guided out of the group of mesh side yarns 1 toward the fight at a suitable time and a new formation of a function yarn reserve is effected by means of the system 11.

FIG. 10 shows a warp knitting work location with a system 11 for forming function yarn reserves according to the invention. In a known manner, in cooperation with the combined hold-down sinkers and knock-over sinkers 17, the slide needles 5 which are arranged in a row adjacent to one another on the needle bar 6 along with the closing wires 7 associated with these slide needles 5 form the mesh sides of the net in the working direction from the group of mesh side yarns 1 which is fed by means of the eye needles 16 and is formed of the warp yarns 18 and function yarns 4.

The function yarn 4 is tied up in the mesh side of the net. According to the invention, a system 11 for forming a function yarn reserve which acts at least between two slide needles 5 adjoining one another transversely to the working direction is arranged in the warp knitting work location. The system 11 for forming a function yarn reserve is formed by the hooked needles 12 which are fastened in a row one after the other on the bar extending over the entire width of the machine. The bar is displaceable horizontally and swivelable about its longitudinal axis and is moved by the drive 13, a variation control 14 being associated with the latter. Depending on the mesh geometry, the function yarn 4 is guided out of the group of mesh side yarns 1 by means of the eye needle 16, grasped by the hooked needles 12 by means of the horizontal movement of the bar with the hooked needles 12 in the direction of the slide needles 5 and by a simultaneous downward swiveling movement, and looped to form the function yarn reserve by the subsequent return movement of the bar. The function yarn 4 is then tied on or tied in within the adjacent group of mesh side yarns 1 by the slide needle 5 and the function yarn reserve is thrown off by an upward swiveling movement of the hooked needles 12 and a horizontal movement of same into the initial position.

The invention can be used equally well at warp knitting work locations and stitch bonding work locations with two needle systems or with knitting needles constructed as latch needles or bearded spring needles or at warp knitting work locations or stitch bonding work locations with a round work location.

FIGS. 11*a* to 11*f* show various mesh geometries which can be produced by varying the function yarn feed, the magnitude of the function yarn reserve and the tying in or tying on of the function yarns 4 at the wale. The production position is shown on the left and the use position is shown on the right.

We claim:

1. A device for producing textile net-like fabrics from yarns in a working direction, the device comprising, for feeding to a work location, at least one function yarn feeding means and at least one of a stitching yarn feeding means and a warp yarn feeding means and a stationary weft yarn feeding means, a plurality of adjacent bonding devices for forming mesh sides in the working direction from groups of mesh side yarns, wherein a distance between two adjacent bonding devices corresponds to a length of an unlooped mesh side placed transversely of the working direction, each bonding device comprising a function yard guide means acting on the function yarn and bridging the distance between adjacent bonding devices, and each bonding device further comprising at least one controllable function yarn reserve forming system acting on the function yarn, wherein the function yarn reserve forming system is located between two adjacent bonding devices and comprises elements for forming function yarn reserves.

2. The device according to claim 1, wherein each bonding device comprises a stitch bonding work location.

3. The device according to claim 1, wherein each bonding device comprises a warp knitting work location.

4. The device according to claim 1, wherein each bonding device comprises a crochet galloon work location.

5. The device according to claim 1, wherein the function yarn reserve forming system comprises a drive, wherein the drive comprises at least one of a variation control and a patterning control configured to correlate with controls of the device.

6. The device according to claim 1, wherein, for realizing different, mutually dependent function yarn reserves, the function yarn reserve forming system comprises geometrically differently configured elements selected from the group consisting of needles, hooks, grippers, displacing members, sinkers, and air-bubble tubes.

* * * * *